US008872033B2

(12) United States Patent
Oka et al.

(10) Patent No.: US 8,872,033 B2
(45) Date of Patent: Oct. 28, 2014

(54) CABLE WITH LESS RESIDUAL BEND

(75) Inventors: Fumihito Oka, Hitachi (JP); Hirotaka Eshima, Hitachi (JP); Yoji Kobayashi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 196 days.

(21) Appl. No.: 13/341,324

(22) Filed: Dec. 30, 2011

(65) Prior Publication Data

US 2012/0175146 A1 Jul. 12, 2012

(30) Foreign Application Priority Data

Jan. 7, 2011 (JP) ..... 2011-001974
Dec. 26, 2011 (JP) ..... 2011-282574

(51) Int. Cl.
*H01B 7/18* (2006.01)
*H01B 3/00* (2006.01)

(52) U.S. Cl.
USPC ..... 174/120 R; 174/110 R

(58) Field of Classification Search
CPC ..... H01B 7/18; H01B 3/00; H01B 5/10; H01B 5/105; D07B 2201/1092; D07B 2201/2033; D07B 2201/2056; D07B 2201/2014; D07B 2801/12
USPC ..... 174/120 R, 110 R
See application file for complete search history.

(56) References Cited

U.S. PATENT DOCUMENTS

| | | | | |
|---|---|---|---|---|
| 4,541,686 | A * | 9/1985 | Barfuss et al. | 385/107 |
| 4,815,813 | A * | 3/1989 | Arroyo et al. | 385/102 |
| 4,909,592 | A * | 3/1990 | Arroyo et al. | 385/113 |
| 5,521,358 | A * | 5/1996 | Eilentropp | 219/549 |
| 7,439,844 | B2 * | 10/2008 | Hase et al. | 337/159 |
| 2002/0084099 | A1 * | 7/2002 | Persson | 174/116 |
| 2012/0267164 | A1 * | 10/2012 | Reuss et al. | 174/70 R |

FOREIGN PATENT DOCUMENTS

| | | |
|---|---|---|
| JP | 54-143757 | 11/1979 |
| JP | 01-213912 | 8/1989 |
| JP | 2010-225571 | 10/2010 |

* cited by examiner

*Primary Examiner* — Timothy Thompson
*Assistant Examiner* — Charles Pizzuto
(74) *Attorney, Agent, or Firm* — Roberts Mlotkowski Safran & Cole P.C.

(57) ABSTRACT

A cable with less residual bend includes a sheath as an outermost layer; and a thread for correcting a residual bend. The thread is provided inside the sheath and disposed in parallel with a center axis of the cable along a longitudinal direction of the cable.

13 Claims, 7 Drawing Sheets

CABLE WITH LESS RESIDUAL BEND

The present application is based on Japanese Patent Application No. 2011-001974 filed on Jan. 7, 2011 and Japanese Patent Application No. 2011-282574 filed on Dec. 26, 2011, the entire contents of which are incorporated herein by reference.

BACKGROUND OF THE INVENTION

1. Field of the Invention

The present invention relates to a cable with less residual bend, more particularly to a cable suitable for a cable configured to be installed in a narrow space and subject to repetitive bending, e.g. a cable for IWM (In Wheel Motor) of a vehicle.

2. Related Art

As to the cable configured to be installed in the narrow space and subject to the repetitive bending, e.g. the cable for IWM of a vehicle, if the cable interferes with peripheral members, a sheath of the cable at an interfered part will be worn, thereby resulting in damage of the sheath and disconnection of the cable.

Therefore, it is necessary to avoid the interference with the peripheral members when such a cable is installed (laid-out).

Japanese Patent Laid-Open No. 1-213912 (JP-A 1-213912), Japanese Patent Laid-Open No. 54-143757 (JP-A 54-143757), and Japanese Patent Laid-Open No. 2010-225571 (JP-A 2010-225571) disclose related arts of the present invention.

SUMMARY OF THE INVENTION

In general, cables have the residual bend, since the cables are wound around a drum (reel) when the cables are fabricated.

If the cable having the residual bend is however used for the aforementioned application of use, a trajectory of the cable will be shifted due to the residual bend. Therefore, even if the same cable is used, the cable may interfere with the peripheral members according to the manner of the cable installation (cabling).

Here, the "residual bend" of a cable generally means a state in which a bend remains in the cable after the cable is held at a bending state for a predetermined time and released from the bending state. In the present specification, the state that the cable has the "residual bend" is defined as a state that, after the cable is installed and held at a bending state for a predetermined time and released from the bending state, a bending radius (curvature radius) of the cable after the release is equal to or more than five times of a bending radius (curvature radius) of the cable bending state. Further, the states that the cable "has no residual bend", "is substantially straight", "the residual bend is corrected", etc. are defined as a state that, after the cable is installed and held at the bending state for the predetermined time and released from the bending state, the bending radius (curvature radius) of the cable after the release is less than five times of the bending radius (curvature radius) of the cable bending state. In addition, the "thread" means a lengthy fibrous member which is provided along a longitudinal direction of the cable.

JP-A 1-213912 discloses a conventional cable wire in which the residual bend can be corrected. In the cable wire disclosed by JP-A 1-213912, an adhesive layer comprising a releasable paper at an outer periphery is provided along an overall length of the cable wire. According to this structure, at the time of installing the cable wire, it is possible to fix the cable wire while correcting the residual bend of the cable wire with finger, ruler, etc. by tearing off the releasable paper from the adhesive layer. However, in the cable wire disclosed by JP-A 1-213912, there is a disadvantage in that the workability of the cable installation is remarkably low, since it is necessary for an operator to correct the residual bend of the cable wire slowly at the time of the cable installation.

JP-A 54-143757 discloses an example of conventional cable venders which can correct the residual bend of a cable. In the cable vender disclosed by JP-A 54-143757, a folding type pantograph mechanism is used for correcting the residual bend of the cable. In the cable vender disclosed by JP-A 54-143757, however, a narrow diameter cable may be damaged since the residual bend is corrected by applying an external force to the cable.

On the other hand, JP-A 2010-225571 discloses that, in an electric cable constituting a harness for IWM, a reinforcing braid layer formed by interweaving a plurality of fibers is provided between a second buffer layer and a sheath, so as to increase a tensile strength of the cable. The reinforcing braid layer in the cable disclosed by JP-A 2010-225571 is provided to cover an entire outer periphery of the second buffer layer, but the reinforcing braid layer cannot serve as a member for correcting the residual bend of the cable.

For the purpose of stabilizing the trajectory of the cable at the time of installation and improving the workability of the cable installation, it has been demanded a cable which is substantially straight and has no residual bend when a restricting force is not applied to the cable.

Accordingly, an object of the present invention is to provide a cable with less residual bend.

According to a feature of the present invention, a cable comprising a sheath as an outermost layer, and a thread for correcting a residual bend, the thread being provided inside the sheath and along a longitudinal direction of the cable.

The thread is preferably disposed in parallel with a central axis of the cable.

The thread may be fixed at a predetermined interval to a cable structure disposed inside the sheath along the longitudinal direction of the cable, and the interval of fixing the thread may be shorter than ½ of a length of a cable to be used.

The cable may further comprise a reinforcing braid layer provided inside the sheath, and the thread may be fixed to the reinforcing braid layer by weaving.

The thread may be fixed to at least one of the reinforcing braid layer and the sheath by an adhesive.

The thread may comprise a cotton yarn.

The thread may comprise a rubber.

The sheath may comprise an inner sheath and an outer sheath, and the thread may be disposed between the inner sheath and the outer sheath.

EFFECTS OF THE INVENTION

According to the present invention, it is possible to provide a cable with less residual bend.

BRIEF DESCRIPTION OF THE DRAWINGS

The preferred embodiments according to the invention will be explained below referring to the drawings, wherein:

FIGS. 2A and 2B are schematic diagrams of the cable shown in FIG. 1, wherein FIG. 2A is a cross sectional view thereof and FIG. 2B is a perspective view thereof;

FIGS. 4A and 4B are schematic diagrams of a cable in a second preferred embodiment, wherein FIG. 4A is a cross sectional view thereof and FIG. 4B is a perspective view thereof;

FIGS. 5A and 5B are schematic diagrams of a cable in a third preferred embodiment, wherein FIG. 5A is a cross sectional view thereof and FIG. 5B is a perspective view thereof;

DETAILED DESCRIPTION OF THE PREFERRED EMBODIMENTS

Next, a cable in the preferred embodiments according to the present invention will be explained below in more detail in conjunction with the appended drawings.

First Preferred Embodiment

Figure 1:
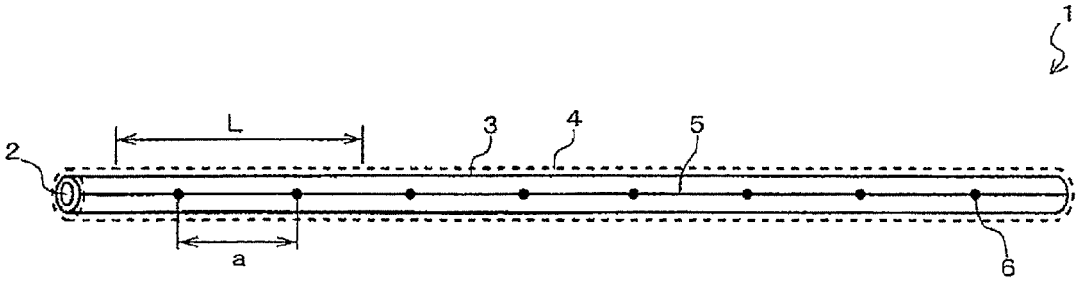
FIG. 1 is an explanatory diagram of a cable in a first preferred embodiment according to the invention, which is a perspective view showing a sheath by a broken line.
Figure 2A:
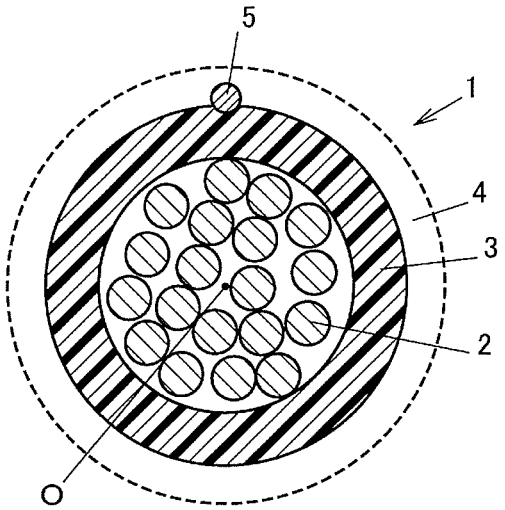
Figure 2B:
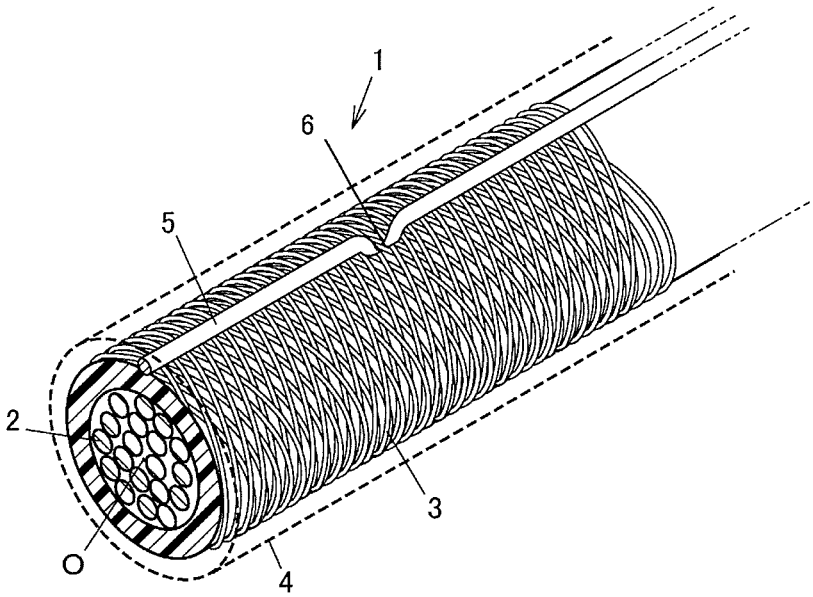

FIG. 1 is an explanatory diagram of a cable in a first preferred embodiment according to the invention, which is a perspective view showing a sheath by a broken line. FIGS. 2A and 2B are schematic diagrams of the cable shown in FIG. 1, wherein FIG. 2A is a cross sectional view thereof and FIG. 2B is a perspective view thereof.

As shown in FIGS. 1, 2A and 2B, a cable 1 comprises a center conductor, and a reinforcing braid layer 3 and a sheath 4 that are sequentially formed in this order around an outer periphery of the center conductor 2. The structure of the cable 1 is not limited to this structure. As long as the cable 1 comprises the sheath 4 as an outermost layer, the cable 1 may have any structure. In FIGS. 1, 2A and 2B, the sheath 4 is shown by a broken line for the purpose of explanation.

The reinforcing braid layer 3 is configured to reinforce the cable 1, and formed by e.g. braiding (interweaving) threads each of which comprises a PET (polyethylene terephthalate) fiber.

In the cable 1 in the first preferred embodiment, a thread 5 for correcting the residual bend of the cable 1 is disposed inside the sheath 4 along a longitudinal direction of the cable 1.

Further, the thread 5 is preferably disposed in parallel with a center axis O of the cable 1 along the longitudinal direction of the cable 1.

As the material of the thread 5, it is preferable to use a material with less elongation, which provides the thread 5 itself with less residual bend. For example, a cotton yarn (e.g. so-called "kite string") and a PET (polyethylene terephthalate) fiber may be used for the material of the thread 5. The thread 5 is fixed at a predetermined interval to a cable structure disposed inside the sheath 4 along the longitudinal direction of the cable 1. Although FIG. 1 shows the case where the thread 5 is fixed to the reinforcing braid layer 3, the thread 5 may be fixed to the center conductor 2. In the present preferred embodiment, the thread 5 is fixed to the reinforcing braid layer 3 by weaving the thread 5 into the reinforcing braid layer 3. In FIG. 1, a reference numeral 6 indicates a portion in which the thread 6 is fixed to the reinforcing braid layer 3 (hereinafter, referred to as "fixing portion 6").

Further, the material of the thread 5 is not limited to the aforementioned cotton yarn ("kite string") and the PET fiber. Herein, the cotton yarn ("kite string") is a strand of cotton fibers, which generally has a diameter of about 0.5 mm to 5.5 mm. As a material of the thread 5, organic fibers such as natural fiber, semi-synthetic fiber, and synthetic fiber are preferable. More concretely, the synthetic fibers such as polyester including polybutylene terephthalate (PBT) other than the polyethylene terephthalate (PET), vinyl on, and nylon, aromatic polyamide fiber, the semi-synthetic fibers such as viscose rayon, and the natural fibers such as cotton yarn and silk yarn may be used.

As shown in FIG. 1, the interval for fixing the thread 5, namely a pitch of fixing portions 6 (fixing pitch a) is determined to be shorter than ½ of a cable length L of a cable to be used. In other words, the fixing pitch a is set such that the thread 5 is fixed in at least two points of the longitudinal direction of the cable 1 having an overall length L even though the cable 1 is cut at an arbitrary point. The reason therefor can be explained as follows. If the thread 5 is fixed in at least two points of the longitudinal direction, the effect of suppressing the residual bend by the thread 5 can be provided, so that the cable 1 after cutting will have no residual bend. In the present application, the "length L of the cable to be used" is a length of the cable 1 after cutting when the cable 1 is actually installed, and also a length of the shortest cable 1 which can be expected.

(Function and Effect of the First Preferred Embodiment)

Figure 3:
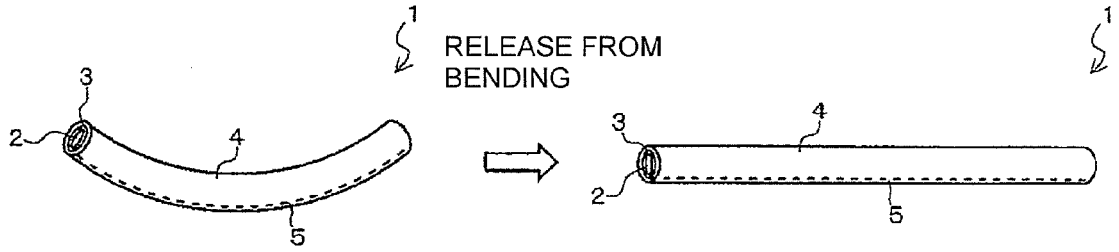
FIG. 3 is an explanatory diagram for showing the function and effect of the cable shown in FIG. 1.

FIG. 3 is an explanatory diagram for showing the function and effect of the cable shown in FIG. 1.

Next, the mechanism of suppressing the residual bend of the cable by providing the thread 5 will be explained below.

In general, when a cable is bent, a tensile force acts on an outer side of bending while a compressive force acts on an inner side of the bending. If the cable is left for a long period in a state that such tensile force and compressive force act on the cable, the cable will have the residual bend.

As to the cable 1 in the first preferred embodiment, when the cable 1 is bend toward such a direction that the thread 5 is provided at the outer side, since the elongation of the thread 5 is small, almost all tensile forces will act on only the thread 5 and the thread 5 functions like a tension member subject to the tensile force. As a result, the sheath 4, etc. provided on the outer side of the bending along a stretching direction hardly deforms. Therefore, as shown in FIG. 3, when the cable 1 is released from the bending state, the cable 1 comes back to a straight state immediately because of restoring forces of the thread 5 and the sheath 4.

It should be noted that the thread 5 has not only a function of correcting the residual bend of the cable 1 but also a function of improving a tensile strength of the cable 1 like the tension member, however, that the conventional tension member does not necessarily have the function of correcting the residual bend of the cable.

Namely, in the cable 1, when the cable 1 is bent along such a direction that the thread 5 is located on the outer side of bending, the cable 1 does not have the residual bend. Therefore, it is necessary to wind the thread 5 around a drum (reel) such that the thread 5 is located on the outer side of bending, when the cable 1 is wound around the drum (reel) for manufacturing or keeping the cable 1. In addition, it is preferable to provide a mark (e.g. a line formed along the longitudinal direction of the cable 1) on the outer periphery of the sheath 4 at the location that the thread 5 is positioned, so as to specify the bending direction by which the cable 1 will not have the residual bend.

Even if the cable 1 is bent along such a direction that the thread 5 is located on the outer side of the bending, when a bending radius of the cable 1 is very small, it is assumed that a large compressive force will act on the inner side of the bending, thereby a portion located at the inner side of the bending will have the residual bend. However, when the thread 5 is provided in the cable 1, it is hard to bend the cable 1 along such a direction that the thread 5 is located at the outer side of the bending. Therefore, it is difficult to bend the cable to have such a bending radius that the cable 1 has the residual bend.

As described above, in the cable 1 according to the first preferred embodiment, since the thread 5 for correcting the residual bend is disposed along the longitudinal direction of the cable 1, when the cable 1 is bent along such a direction that the thread 5 is located on the outer side of bending, the cable 1 will not have the residual bend. Therefore, it is possible to realize the cable 1 which is substantially straight when the cable 1 is released from the bending state when the cable 1 is used, namely the cable 1 is in the state that the restrictive force is not applied, by winding the thread 5 around the drum (reel) such that the thread 5 is located on the outer side of bending. As a result, the trajectory of the cable 1 at the time of cable installation is stabilized and the interference with the peripheral members can be avoided. Further, since the cable 1 can be easily installed in the narrow space, it is possible to improve the workability of the cable installation.

Further, it is possible to change the bending property in a circumferential direction of the cable 1 by arranging the thread 5 inside the sheath 4. In other words, it is possible to fabricate the cable 1 which is hard to be bent only when the cable 1 is bent such that the thread 5 is located at the outer side. A bending hardness of the cable 1 can be controlled by adjusting the elongation property of the thread 5. Therefore, it is possible to design a cable configuration in cabling (the trajectory of the cable 1) as desired by controlling the location and elongation property of the thread 5.

Still further, in the cable 1, since the thread 5 is fixed to the cable structure disposed inside the sheath 4, even if the thread 5 is not fixed to the cable 1 at both ends of the cable 1 (i.e. the both ends of the cable 1 is not crimped), the thread 5 will not be shifted. Therefore, the cable 1 can be kept and transported in the state that the cable 1 is wound around the drum (reel), etc., and the cable 1 can be cut and processed into a cable with a terminal as necessity.

In addition, in the cable 1, since the fixing pitch 1 of the thread 5 is set to be shorter than ½ of the length L of the cable to be used, even in the cut cable 1, it is possible to suppress the residual bend, when the cable 1 is bent such that the thread 5 fixed to the cable 1 in at least two points is located at the outer side of the bending.

Second Preferred Embodiment

Figure 4A:
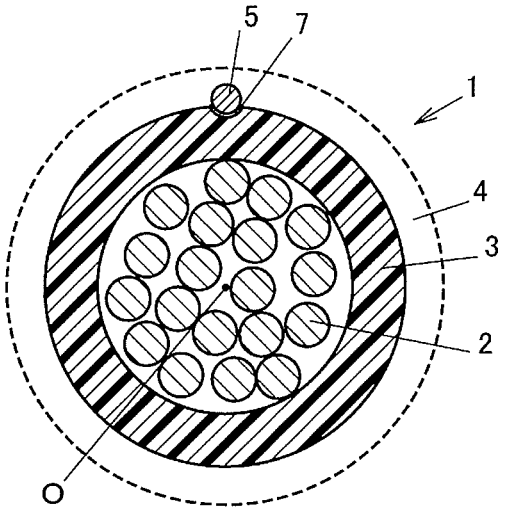
Figure 4B:
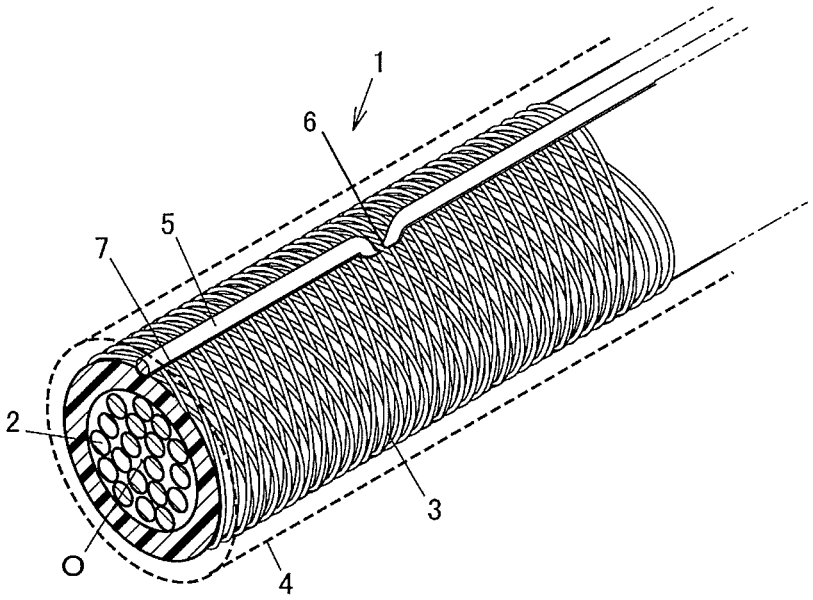

FIGS. 4A and 4B are schematic diagrams of a cable in a second preferred embodiment, wherein FIG. 4A is a cross sectional view thereof and FIG. 4B is a perspective view thereof. A cable 1 is configured such that the thread 5 is fixed to a cable structure by an adhesive material as well as the thread 5 is fixed to the cable structure at the fixing portion 6. Hereinafter, in the second preferred embodiment, the same reference numerals as the first preferred embodiment are assigned to the elements having the same or similar structure and function as those of the first preferred embodiment, and the detailed description thereof is omitted.

As described above, in the first preferred embodiment, the thread 5 is fixed to the reinforcing braid layer 3 at the fixing portion 6 by weaving the thread 3 into the reinforcing braid layer 3. In the present preferred embodiment, the thread 5 is further fixed to the cable structure, more particularly to, at least one of the reinforcing braid layer 3 and the sheath 4 by an adhesive 7.

For example, the thread 5 may be fixed to at least one of the reinforcing braid layer 3 and the sheath 4, by disposing the thread 5 containing the adhesive 7 between the reinforcing braid layer 3 and the sheath 4. Alternatively, the adhesive 7 may be coated on the reinforcing braid layer 3, and the thread 5 may be attached thereon.

As the adhesive 7, it is preferable to use resorcinol formaldehyde latex (RFL), but the present invention is not limited thereto. General organic adhesives and synthetic adhesives may be used as the adhesive 7.

(Function and Effect of the Second Preferred Embodiment)

In the cable 1 in the first preferred embodiment, the thread 5 is fixed to the reinforcing braid layer 3 by partially weaving the thread 6 into the reinforcing braid layer 3. Namely, since the thread 5 is fixed at the fixing portion 6 of the reinforcing braid layer 3 by point-contact, the thread 5 may be shifted inside the cable 1 when the cable 1 is bent. As a result, the rigidity and layout of the cable 1 may be varied.

On the other hand, according to the cable 1 in the second preferred embodiment, the adhesive 7 is further used for fixing the thread 5, so that the thread 5 is fixed by point-contact at the fixing portion 6 of the reinforcing braid layer 3, and further fixed by plane-contact at the portion other than the fixing portion 6. Therefore, it is possible to reduce the variation in the rigidity and layout of the cable 1 due to the shifting of the thread 5 inside the cable 1 when the cable 1 is bent.

Third Preferred Embodiment

Figure 5A:
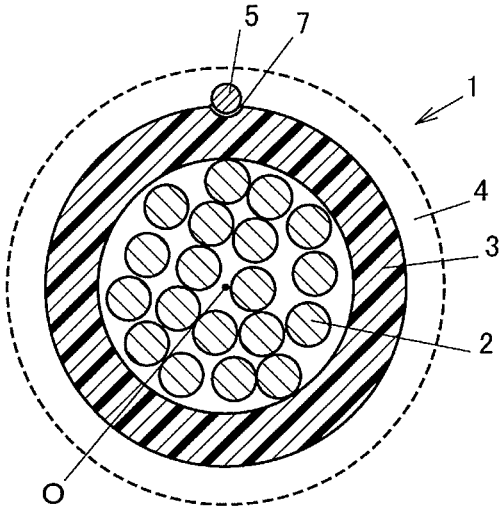
Figure 5B:
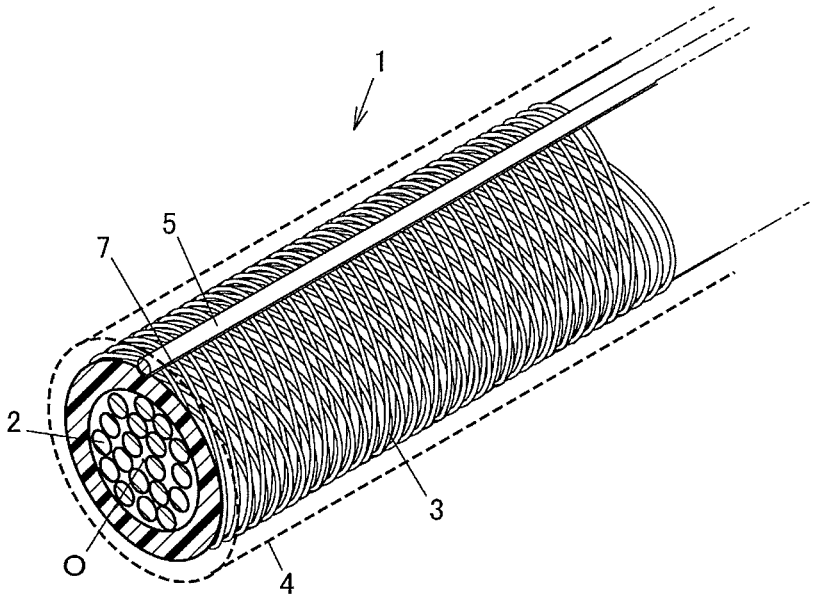

FIGS. 5A and 5B are schematic diagrams of a cable in a third preferred embodiment, wherein FIG. 5A is a cross sectional view thereof and FIG. 5B is a perspective view thereof. A cable 1 is configured such that the thread 5 is fixed to the cable structure only by the adhesive 7. Hereinafter, in the third preferred embodiment, the same reference numerals as the second preferred embodiment are assigned to the elements having the same or similar structure and function as those of the second preferred embodiment, and the detailed description thereof is omitted.

As described above, in the third preferred embodiment, the thread 5 is fixed to the cable structure, more particularly to, at least one of the reinforcing braid layer 3 and the sheath 4 only by the adhesive 7 without the fixation at the fixing portion 6.

(Function and Effect of the Third Preferred Embodiment)

According to the cable 1 in the third preferred embodiment, the thread 5 is fixed by plane-contact to the reinforcing braid layer 3 by using the adhesive 7, similarly to the cable 1 in the second preferred embodiment. Therefore, it is possible to reduce the variation in the rigidity and layout of the cable 1 due to the shifting of the thread 5 inside the cable 1 when the cable 1 is bent. Further, since the thread 5 is not fixed at the fixing portion 6 by weaving, it is possible to reduce the number of working steps compared with the cable 1 in the second preferred embodiment.

(Variations)

In the first to third preferred embodiments, the case of using only a single thread 5 is explained. However, the present invention is not limited thereto. Plural threads 5 may be used. When the plural threads 5 are used, the threads 5 may be disposed at regular intervals in the circumferential direction. Alternatively, the threads 5 may be disposed at irregular intervals in the circumferential direction, so as to provide a cable which is hardly bent along an arbitrary direction.

Further, in the first to third preferred embodiment, the case of using the cotton yarn, etc. with a small elongation is explained. However, the present invention is not limited thereto. For example, a material having a large restoring force such as rubber may be used. In this case, the tensile force applied to the thread 5 when the cable 1 is bent is reduced. However, the cable 1 can be provided with a large restoring force when the cable 1 is released from the bending state, so that it is possible to suppress the residual bend of the cable 1.

FIGS. 6A to 6E are cross sectional views of cables in variations of the present invention, respectively.

Figure 6A:
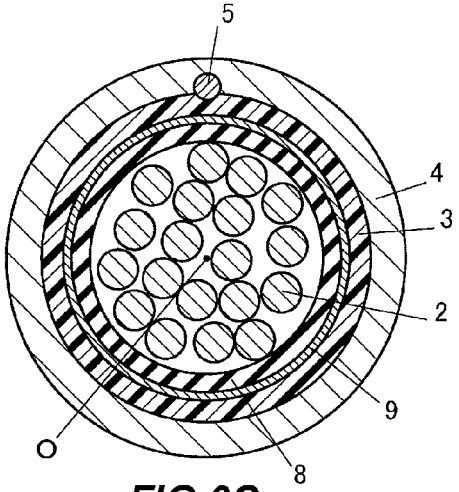
FIGS. 6A to 6E are cross sectional views of cables in variations of the present invention, respectively.

In a variation shown in FIG. 6A, a cable 1 comprises a plurality of conductors 2, and an insulator 8, a shield 9, a reinforcing braid layer 3, and a sheath 4 that are sequentially formed in this order around an outer periphery of the plurality of conductors 2. The number of thread 5 is one, and the thread 5 is disposed outside the reinforcing braid layer 3 and inside the sheath 4, and disposed in parallel with a center axis O of the cable 1 along a longitudinal direction of the cable 1.

Figure 6B:
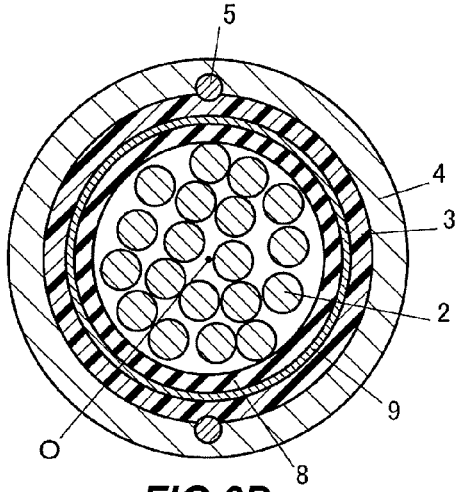

In a variation shown in FIG. 6B, a cable 1 has a configuration similar to the configuration of cable 1 shown in FIG. 6A. However, the number of the threads 5 is two, and the two threads 5 are disposed in parallel with the center axis O of the cable 1, and are disposed uniformly in the circumferential direction. Namely, the two threads 5 are disposed with intervals of 180 degrees.

Figure 6C:
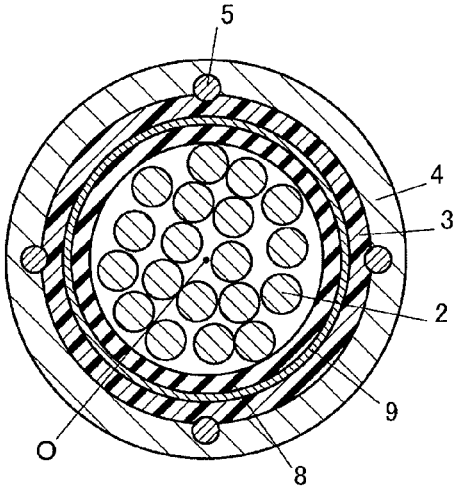

In a variation shown in FIG. 6C, a cable 1 has a configuration similar to the configuration of cable 1 shown in FIG. 6B. However, the number of the threads 5 is four, and the four threads 5 are disposed uniformly in the circumferential direction. Namely, the four threads 5 are disposed with intervals of 90 degrees.

Figure 6D:
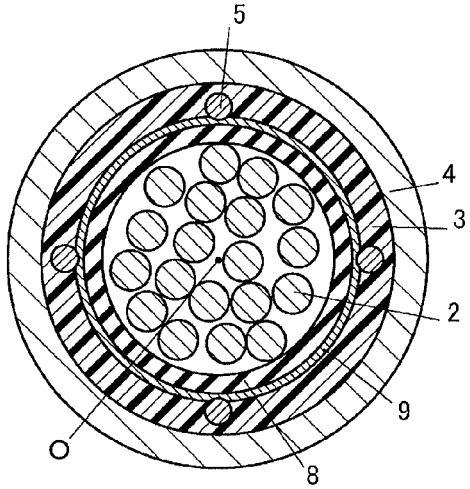

In a variation shown in FIG. 6D, a cable 1 has a configuration similar to the configuration of cable 1 shown in FIG. 6C. However, the four threads 5 are disposed outside the shield 9 and inside the reinforcing braid layer 3.

Figure 6E:
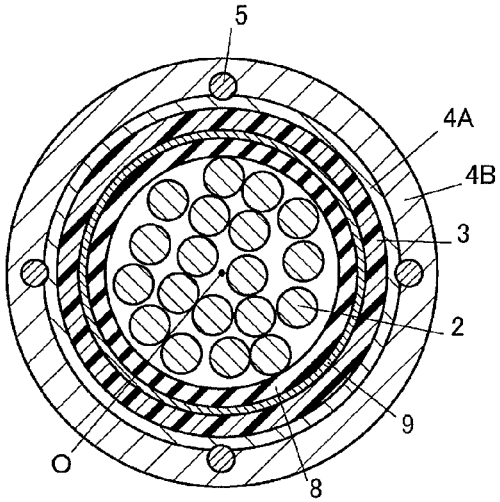

In a variation shown in FIG. 6E, a cable 1 has a configuration similar to the configuration of cable 1 shown in FIG. 6C. However, the sheath 4 has a double layer configuration comprising an inner sheath 4A and an outer sheath 4B, and the four threads 5 are disposed outside the inner sheath 4A and inside the outer sheath 4B, i.e. between the inner sheath 4A and the outer sheath 4B. Namely, the four threads 5 are buried within the sheath 4 having the double layer configuration.

Variations of the present invention is not limited to the aforementioned variations, and include a combination thereof, variations with different number of the threads 5, and variations including the threads 5 that are disposed irregularly. Further, variations excluding the shield 9 and/or the reinforcing braid layer 3 are also included in the scope of the present invention.

EXAMPLES

Example 1

As a sample of Example 1, around an outer periphery of a plurality of copper wires (equivalent to a cross sectional area of 5.5 $mm^2$) as a plurality of conductors 2, a polyethylene layer (a thickness of 0.6 mm) as an insulator 8, a copper braid shield as a shield 9, a PET fiber braid layer as a reinforcing braid layer 3, and an EPDM (Ethylene Propylene Diene Monomer rubber) layer (a thickness of 0.6 mm) as a sheath 4 were sequentially formed in this order, to provide a cable 1 (an outer diameter of 8.5 mm) having a configuration as shown in FIG. 6A. A PET fiber of 150 dtx (deci tex) was used as a thread 5, and the single thread 5 was fixed to the reinforcing braid layer 3 by weaving the thread 5 into the reinforcing braid layer 3 at a regular pitch (100 mm).

Here, the EPDM was used for the material of the sheath 4 in Example 1, however, the present invention is not limited thereto. In addition, butyl rubber, chloroprene rubber, chlorosulfonated polyethylene (CSM) rubber, silicon rubber, natural rubber, fluororesin, polyethylene, various vinyl, polytetrafluoro ethylene (PTFE), polyurethane, or the like may be used as the material of the sheath 4.

Comparative Example 1

As a sample of Comparative example 1, a cable having a configuration similar to Example 1 without using the thread 5 was prepared.

(Analysis of Residual Bend)

Analysis of the residual bend of cables was carried out by winding a cable (a length of 1000 mm) around a drum (a diameter of 300 mm), leaving the cable in a restricting state (a bending radius of 150 mm) for one day, and measuring a curvature radius of the cable after being released from the restriction. Here, the cable 1 including the thread 5 in Example 1 was bent such that the thread 5 was located at the outer side of the cable 1.

Just after the release, a minimum curvature radius R of the cable in Example 1 was about 1800 mm, i.e., substantially straight. On the other hand, the minimum curvature radius R of the cable in Comparative example 1 was 350 mm, and the residual bend was observed.

Example 2

As a sample of Example 2, a cable 1 (an outer diameter of 8.5 mm) having a configuration similar to Example 1 was prepared. In Example 2, however, four threads 5 were used similarly to the configuration shown in FIG. 6C. Further, silicone rubber strings (a diameter of 0.6 mm) were used as the threads 5. The thread 5 made of silicone rubber string was fixed to the reinforcing braid layer 3 at a half-way point along the longitudinal direction of the cable 1. In Example 2, the fixation of the thread 5 was carried out by binding the thread 5 made of silicone rubber string to the reinforcing braid layer 3 with the use of a PET fiber. Alternatively, the fixation of the thread 5 may be carried out by using an adhesive. In addition, the thread 5 made of silicone rubber string was fixed at three points in total, i.e. both ends and the half-way point of the cable 1 by crimping the both ends of the cable 1 with metal fittings.

Comparative Example 2

As a sample of Comparative example 2, a cable having a configuration similar to Example 2 without using the thread 5 was prepared.

(Analysis of Residual Bend)

Figure 7:
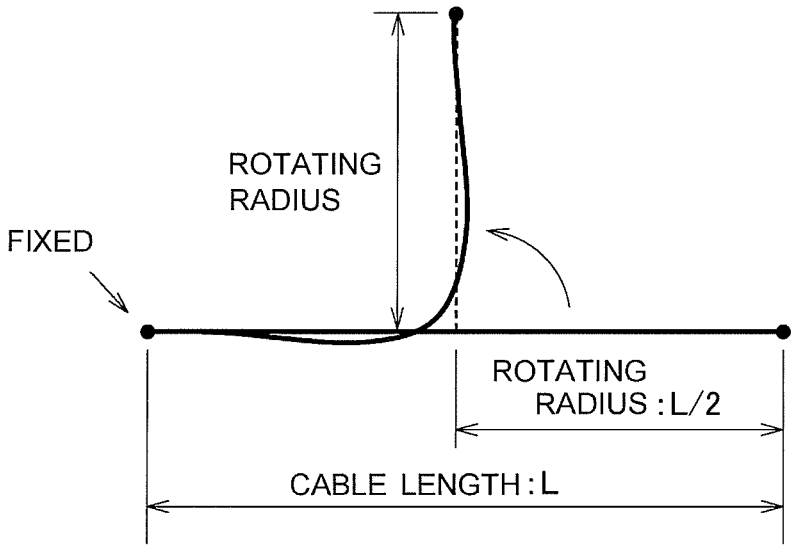
FIG. 7 is an explanatory diagram for showing a method of measuring the "residual bend" of the cable in the present invention.

FIG. 7 is an explanatory diagram for showing a method of measuring the residual bend of the cable in the present invention. For the analysis of the residual bend of the cable, cables with a length of 400 mm were used.

As shown in FIG. 7, the analysis of the residual bend of cables was carried out by bending and fixing the cable into a L-shape at a rotating radius L/2 which is a half of a cable length L, leaving the cable in the bending state for one day, and measuring a curvature radius of the cable after being released from the bending state. Here, a minimum curvature radius R of the cable when the cable is bent in L-shape was 75 mm.

Just after the release, a minimum curvature radius R of the cable in Example 2 was about 400 mm, i.e., substantially straight. On the other hand, the minimum curvature radius R of the cable in Comparative example 2 was 85 mm, and the residual bend was observed.

As a material of the thread 5, silicon rubber having hardness within a range of 30 to 90 of Shore A hardness may be used. Considering the restoring force of the rubber and the bending easiness of the cable, it is preferable to use the silicon rubber having hardness within a range of around 50 to 70 of Shore A hardness for the cable having an outer diameter of 5 to 15 mm.

Although the invention has been described with respect to preferred embodiments and examples, the invention according to the claims is not to be limited by the above-mentioned embodiments and examples. Further, please note that not all combinations of the features described in the embodiments and the examples are necessary to solve the problem of that the invention addresses.

What is claimed is:

1. A cable comprising:

a sheath as an outermost layer;

one or more threads provided inside the sheath and along a longitudinal direction of the cable; and a reinforcing braid layer provided inside the sheath;

wherein the one or more threads are disposed in parallel with a central axis of the cable and contact an outer periphery of the reinforcing braid layer and an inner periphery of the sheath, wherein the one or more threads are fixed to the reinforcing braid layer by being woven into the reinforcing braid layer such that the one or more threads penetrate through the reinforcing braid layer from the outer periphery of the reinforcing braid layer to inside of the reinforcing braid layer and come back from the inside of the reinforcing braid layer to the outer periphery of the reinforcing braid layer.

2. The cable according to claim 1, wherein the one or more threads are fixed at a predetermined interval to the cable structure along the longitudinal direction of the cable, and the interval of fixing the one or more threads are shorter than ½ of a length of the cable.

3. The cable according to claim 1, wherein the one or more threads are further fixed to at least one of the reinforcing braid layer and the sheath by an adhesive.

4. The cable according to claim 1, wherein the one or more threads comprise a cotton yarn.

5. The cable according to claim 1, wherein the one or more threads comprise a rubber.

6. The cable according to claim 1, wherein the sheath comprises an inner sheath and an outer sheath, and the one or more threads are disposed between the inner sheath and the outer sheath.

7. The cable according to claim 1, wherein the one or more threads correct a residual bend.

8. The cable according to claim 1, wherein the one or more threads comprise a hardness within a range of 30 to 90 of Shore A hardness.

9. The cable according to claim 1, wherein the cable comprises an outer diameter of 5 to 15 mm and the one or more threads comprise a hardness within a range of 50 to 70 of Shore A hardness.

10. The cable according to claim 1, wherein the one or more threads comprise an electrically non-conductive material.

11. The cable according to claim 1, wherein the one or more threads comprise a silicon rubber.

12. The cable according to claim 1, wherein the one or more threads comprise a diameter of 0.5 mm to 5.5 mm.

13. The cable according to claim 1, wherein the one or more threads comprise plural threads disposed uniformly at a predetermined interval in a circumferential direction.

* * * * *